US008161861B2

(12) United States Patent
Haley et al.

(10) Patent No.: US 8,161,861 B2
(45) Date of Patent: Apr. 24, 2012

(54) BATTERY ASSIST DEVICE

(75) Inventors: Travis D. Haley, Montrose, CO (US); Eric C. Burt, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 221 days.

(21) Appl. No.: 12/540,345

(22) Filed: Aug. 12, 2009

(65) Prior Publication Data

US 2010/0251591 A1 Oct. 7, 2010

Related U.S. Application Data

(60) Provisional application No. 61/165,656, filed on Apr. 1, 2009.

(51) Int. Cl.
*F41A 3/72* (2006.01)

(52) U.S. Cl. ..... 89/1.4

(58) Field of Classification Search ..... 89/1.4; 42/70.11, 1.05

See application file for complete search history.

(56) References Cited

U.S. PATENT DOCUMENTS 5,179,245 A * 1/1993 Straka ..... 89/1.4
6,311,603 B1 * 11/2001 Dunlap ..... 89/1.4
7,798,045 B1 * 9/2010 Fitzpatrick et al. ..... 89/1.4

OTHER PUBLICATIONS

Wagner, Steve, AR Style Bolt Release Extension, retrieved Jun. 21, 2010, dated through archive.org to Jun. 2003; www.gswagner.com/forsale/boltrelease.htm.

* cited by examiner

*Primary Examiner* — Stephen M Johnson
(74) *Attorney, Agent, or Firm* — Geoffrey E. Dobbin

(57) ABSTRACT

The present invention is a battery assist devise to aid in the locking and unlocking of the bolt in a long firearm. The battery assist devise attaches to the both catch button of the firearm and thereafter acts as an extension thereof. The battery assist device comprises an interface head and attachment plate, which secure about the bolt catch button, and a curved lever that protrudes from the head and projects around the underside of the firearm, through the trigger guard area, until it projects slightly on the opposite side of the firearm. The lever then is capable of ambidextrous operation.

5 Claims, 4 Drawing Sheets

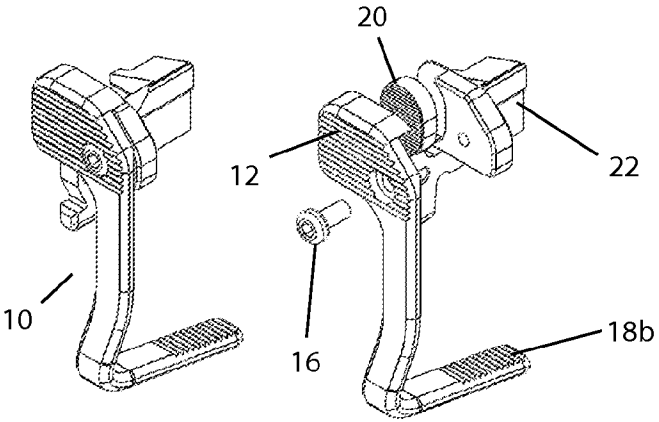
FIG.4
FIG.5
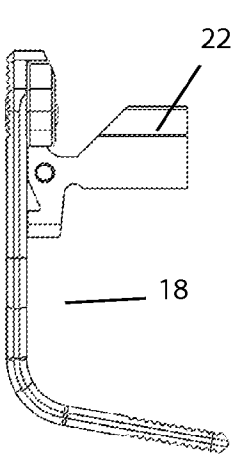
FIG.6
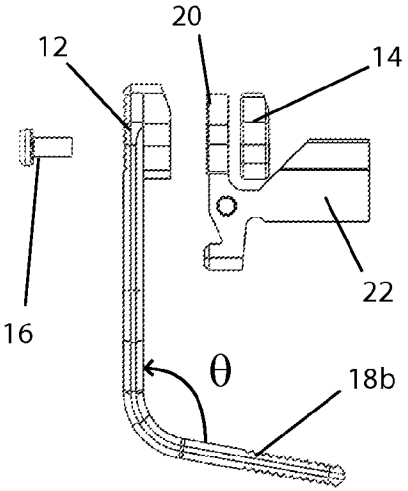
FIG.7
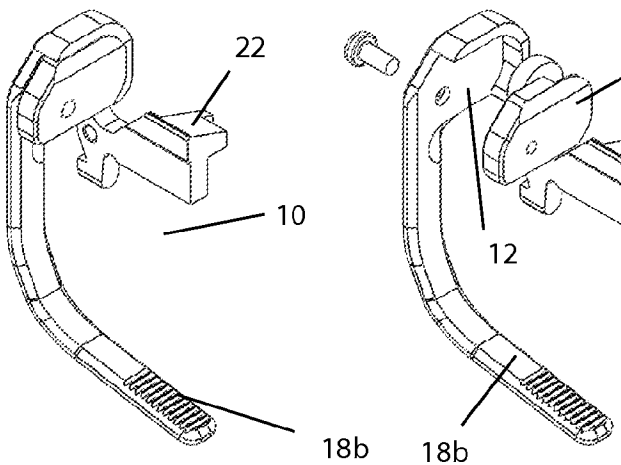
FIG.8
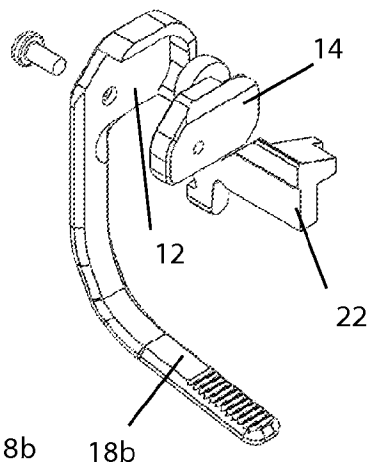
FIG.9
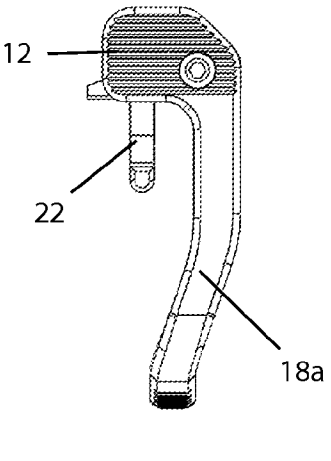
FIG.10
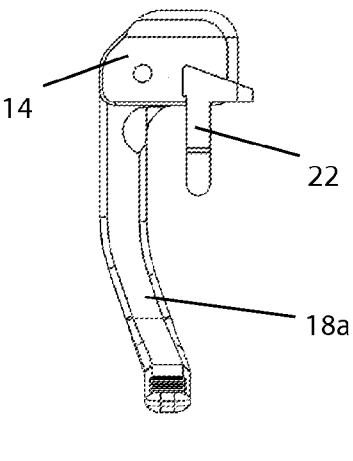
FIG.11

BATTERY ASSIST DEVICE

CROSS-REFERENCES TO RELATED APPLICATIONS

The present application claims priority as a non-provisional perfection of prior file U.S. Provisional Application No. 61/165,656, filed Apr. 1, 2009, and incorporates the same by reference in its entirety herein.

FIELD OF THE INVENTION

The present invention relates to the field of firearms and more particularly relates to a battery assist device to lock or unlock the firing bolt in firearms.

BACKGROUND OF THE INVENTION

A battery device is a device used to aid in the safe, manual adjustment of a firearm to place it in or out of a battery position—that is being ready to fire. Such devices are usually enhancements and attachments to the bolt catch of a firearm, so as to make it more efficient and/or ergonomic to operate. The bolt catch is to be used in operating a firearm so as to secure the bolt and prevent its accidental release, particularly in reloading or the diagnosing and addressing of weapon malfunctions. Frequently, these devices are extensions attached to the bolt catch button to make it larger or more easily activated. However, making the button easier to actuate also makes it easier to accidentally actuate. On long arms, the bolt catch button is most often found on the side of the weapon which is opposite from the user's dominate side. Thus on the side that is most easily reached by the user's non-firing hand but usually not in a position that is immediately accessible without re-positioning the non-firing hand. This then, requires the user either to release their non-firing hand grip or reach over/under the weapon with the firing hand to activate the bolt catch button. To date, battery assist devices are found on the same side as the bolt catch button and have not addressed the inconvenience of having to reposition either the firing or non-firing hand.

What is needed then, is a battery assist device that is unobtrusive, but yet also ambidextrous and easy to operate with either hand. The present invention is an ambidextrous lever attachment connectable to the bolt catch button of an AR15 or similarly equipped weapon platform. Use of the invention allows for single-hand activation of the bolt catch button with the firing hand, without releasing hold of the weapon during either right or left-hand use. In so doing, magazine changes and clearing weapon malfunctions are more efficient and faster—saving precious time in competitions and in battle scenarios.

The present invention represents a departure from the prior art in that the BAD of the present invention allows for ambidextrous operation of the bolt catch button.

SUMMARY OF THE INVENTION

The Battery Assist Device was developed out of a necessity for the Tactical and Competition markets to make the AR15 platform more efficient and increase the performance of the shooter and to maximize efficiencies. Since it is nearly impossible to incorporate an internal Battery Assist Device in the AR15 lower receiver, the Battery Assist Device ("BAD") is a simple aftermarket external accessory that is easily installed without the need of a gunsmith.

Unlike some other aftermarket accessories the BAD gives the shooter an ambidextrous system that both locks the bolt to the rear and also releases it. This aids in lessening time for reloads and also decreases the time and inefficiencies that it takes to clear malfunctions. The BAD does not interfere with the operation of the weapon, and in fact is a lever extension of the AR15's own bolt catch button. If the BAD lever breaks the weapon still functions normally.

The BAD's functionality significantly reduces steps and inefficiencies in the methodologies given to reload a firearm and to clear malfunctions. Examples of such follow:

The reload with a normal M4 configuration, according to the manual of arms:

1. Bolt locks to the rear on last round;
2. Operator presses the magazine release to drop the magazine free to the ground with trigger finger;
3. Operator inserts a new magazine in the magazine well with non-firing hand;
4. Operator presses the bolt catch with non-firing hand's thumb;
5. Operator then requires a grip on the rifle with non-firing hand.

Reloading with the BAD:

1. Bolt locks to the rear on last round;
2. Operator presses the magazine release to drop the magazine free to the ground with trigger finger;
3. Operator inserts a new magazine in the magazine well with non-firing hand;
4. Operator presses the BAD with trigger finger while at the same time reacquiring grip on the rifle with the non-firing hand.

The reload with the BAD, therefore, takes 1 step out of the manual of arms and eliminates 2 inefficiencies The Double feed malfunction with a normal M4 configuration:

1. Identify malfunction;
2. Move non-firing hand back to press the small bolt catch button;
3. Remove fire control hand from fire control and come over top of weapon to grab charging handle;
4. Pull charging handle to rear and then press bolt catch button;
5. Reacquire grip on weapon with firing hand;
6. Strip magazine;
7. Rack the bolt 3 times;
8. Insert magazine;
9. Charge weapon with non fire hand;
10. Then reacquire grip on weapon with non-firing hand.

The double feed malfunction with BAD:

1. Identify malfunction;
2. With non-firing hand grab charging handle and pull to rear at the same time engaging the BAD lever (weapon will lock to rear);
3. Strip magazine;
4. Rack the bolt 3 times on $3^{rd}$ rack engage BAD and locks bolt to rear;
5. Insert magazine;
6. Operator presses the BAD with trigger finger while at the same time reacquiring grip on the rifle with the non-firing hand.

Use of the BAD takes 3 steps out of the manual of arms and eliminates 5 inefficiencies.

As the examples show the BAD lever not only increases speed and minimizes excessive waste movements (which is huge for the competition communities) but it also increases overall survivability rate of the shooter in a tactical "time is life" situation which proves worthy in the Military or Law Enforcement communities as well.

In view of the foregoing disadvantages inherent in the known types of bolt catch devices, this invention provides a battery assist device that serves to efficiently operate the weapon's own bolt catch button. As such, the present invention's general purpose is to provide a new and improved battery assist device that is easy to use, ergonomic and ambidextrous.

To accomplish these objectives, the BAD comprises a curved lever body with a button interface end. The button interface end is designed to envelop the outer body of the firearm's own bolt catch button (which extends slightly outside the firearm such that the rear of the button is accessible). A small plate slides behind the bolt catch button and is fastened to the BAD's interface end, thus capturing the bolt catch button. The curved lever body extends downward relative to the firearm and extends through the trigger guard area. The curve is such that the BAD lever may be pressed downward or upward and in so doing it will act as its own pivot and transmit force to the bolt catch button, capturing and releasing the bolt.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 4 is left perspective view of the BAD of FIG. 1, attached to a bolt catch.

FIG. 5 is an exploded view of the assembly of FIG. 4.

FIG. 6 is a front plan view of the assembly of FIG. 4.

FIG. 7 is an exploded view of the assembly of FIG. 6.

FIG. 8 is a right perspective view of the assembly of FIG. 4.

FIG. 9 is an exploded view of the assembly of FIG. 8.

FIG. 10 is a left plan view of the assembly of FIG. 4.

FIG. 11 is a right plan view of the assembly of FIG. 4.

DETAILED DESCRIPTION OF THE PREFERRED EMBODIMENT

Figure 2:
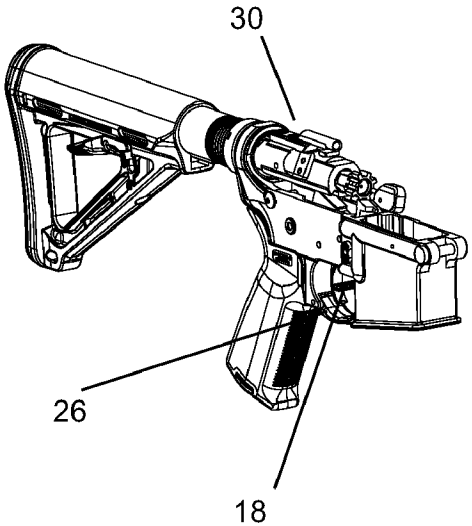
FIG. 2 is a right perspective view of the lower receiver of FIG. 1.

With reference now to the drawings, the preferred embodiment of the battery assist device is herein described. It should be noted that the articles "a", "an", and "the", as used in this specification, include plural referents unless the content clearly dictates otherwise.

With reference to the Figures, the BAD 10 is attached to the bolt catch button 20 of a receiver 30. The BAD 10 comprises three major components: the interface head ("head") 12, the attachment plate 14 and the lever 18. Head 12 is configured to abut the bolt catch button 20 and surround it on its outer face. Attachment plate ("plate") 14 is positioned behind the bolt catch button 20. Plate 14 and head 12 both have portions askew from the bolt catch button 20 to allow their mutual connection, secured by bolt 16. With the bolt catch button 20 secured between plate 18 and interface head 12, the BAD becomes an extension of the bolt catch button 20 and the associated bolt catch 22, as seen in FIGS. 4-11. Bolt catch button 20 extends through an aperture 24 (FIG. 12) made between the plate 14 and head 12.

Figure 1:
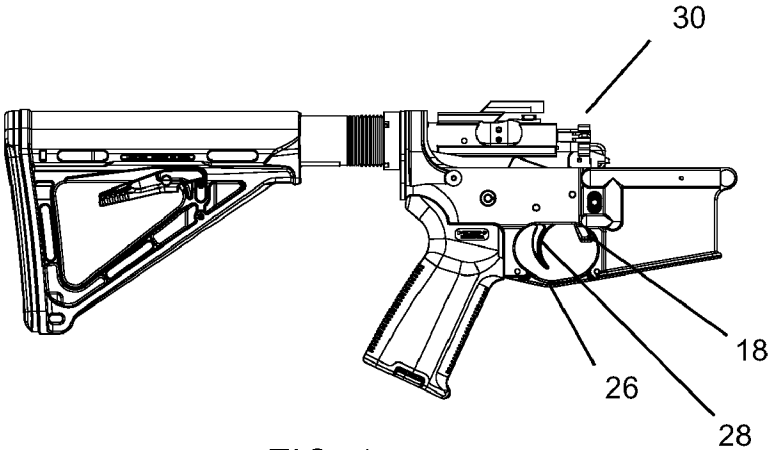
FIG. 1 is a right plan view of an AR15 lower receiver, with an embodiment of the BAD installed.
Figure 3:
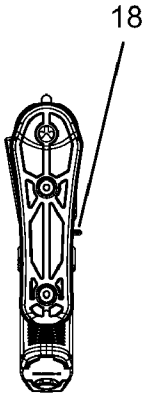
FIG. 3 is a rear plan view of the lower receiver of FIG. 1.

Lever 18 extends downward from the head 12, and is hooked presenting approximately a 90° angle, θ. The angle defining two legs 18*a*, 18*b* and allows the lower leg 18*b* to extend beneath and across the bottom of receiver 30 so that it extends to the other side of the weapon, FIG. 3. The lever 18 extends through an area defined by the trigger guard 26, well forward of the trigger 28, FIGS. 1 and 2, so as to be unobtrusive and prevent accidental activation. Proximity to the trigger area allows the user to activate and deactivate the BAD 10 with the trigger finger. By extending across the bottom of the receiver 30, the lever 18 may be optionally actuated by either the firing or the non-firing hand. The curve of the lever 18 allows the BAD 10 to depend from the bolt catch button 20 without accidental activation or deactivation of the bolt catch 22 and allows for more efficient transmission of force when the BAD 10 is actuated.

Figure 12:
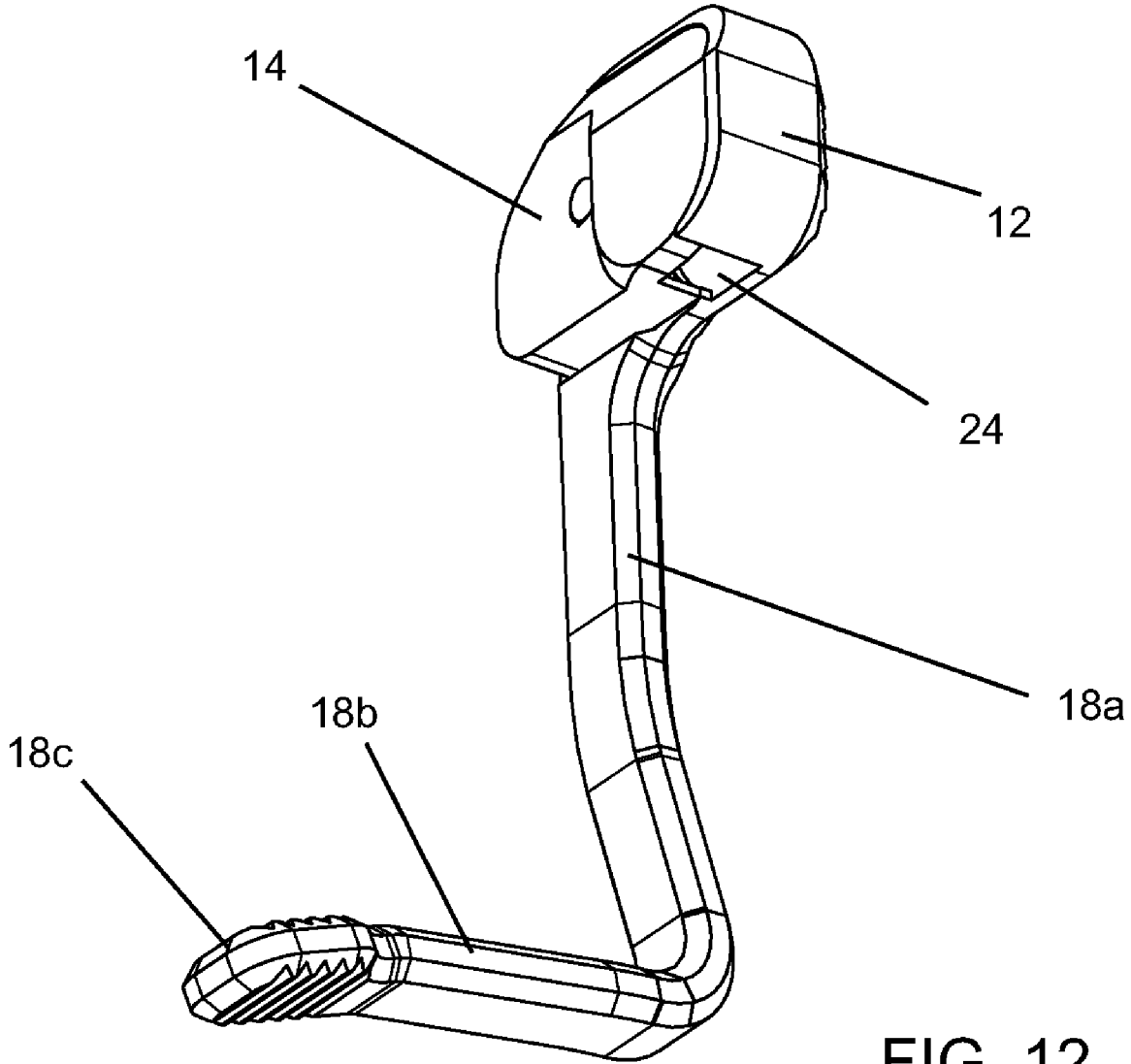
FIG. 12 is a lower perspective view of a preferred embodiment of the BAD, assembled without a bolt catch.
Figure 13:
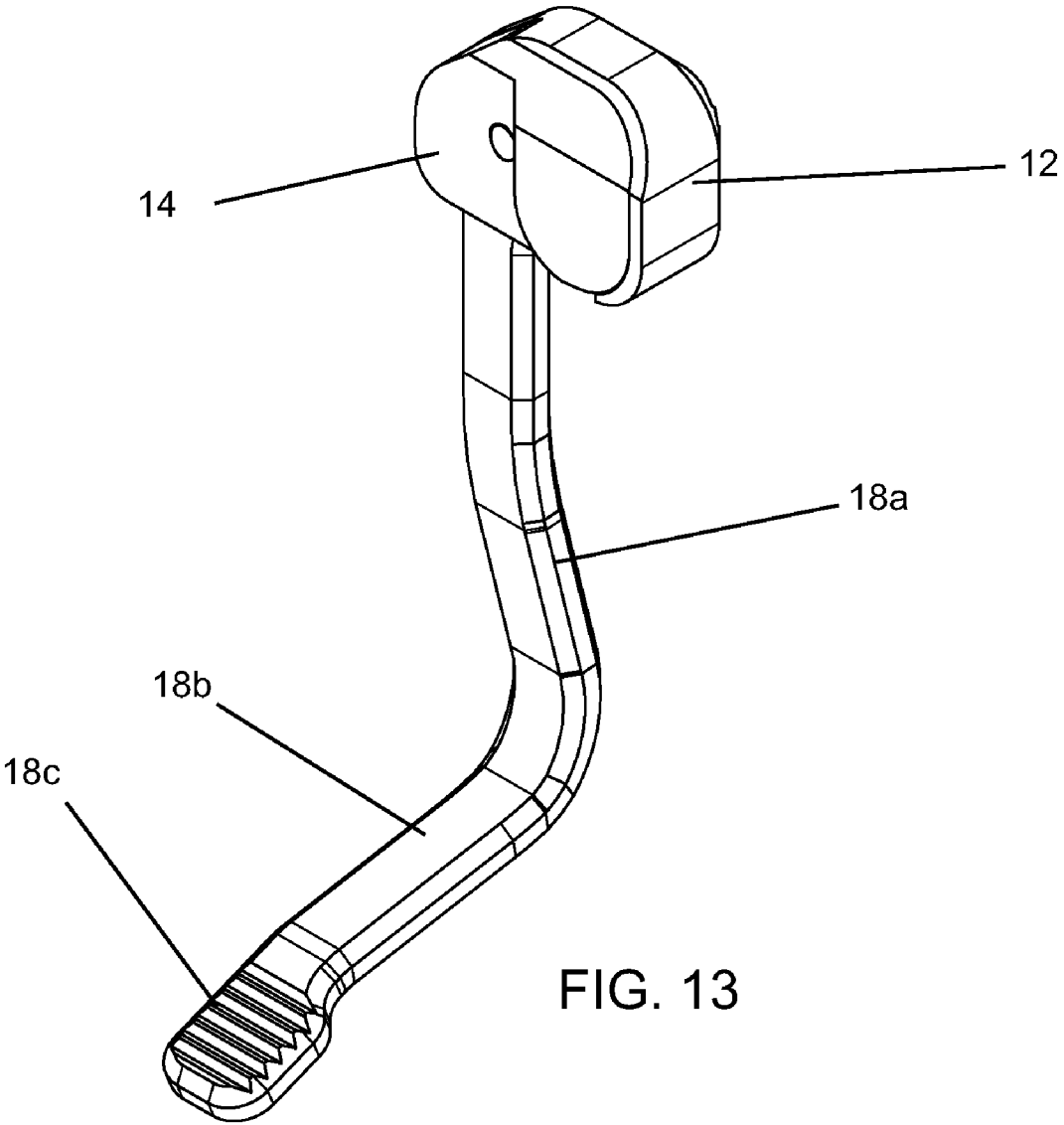
FIG. 13 is an upper perspective view of the BAD of FIG. 12.

In manufacture, the actual dimensions of the BAD 10 will vary as to the platform for which the BAD is designed. As an example, a BAD for an AR15/M16 type receiver is herein described. The head 12 and plate 14, when assembled, should be hollow and have an approximate length of 0.750 inches (19 mm), an approximate width of 0.563 inches (14 mm) and an approximate depth of 0.313 inches (8 mm). Lever 18 should depend from the head 12 and have a total length of about 3 inches (76 mm), divided into upper leg 18*a* (1.625 inches, 41 mm) and lower leg 18*b* (1.375 inches, 35 mm) having a 105° angle θ between them. Lever 18 should have a general width of about 0.219 (5.5 mm) inches and a thickness of approximately 0.125 inches (3 mm), though the tip of lower leg 18*c* may be wider (0.313 inches, 8 mm) and textured (FIGS. 12 and 13). Upper leg 18*a* may be bent to properly position the tip of lower leg 18*b* within the trigger guard 26 of the receiver. Plate 14 and head 12 should nest, but leave an aperture 24 for the access of the bolt catch, about 0.156 inches (4 mm) each side. These measurements are only exemplary and it should be noted that the important features of the invention are that there is a head 12 that encompasses the bolt catch button 20 and a lever 18 extending therefrom that encompasses a part of the receiver 30 to allow actuation of the bolt catch 22 on a side of the receiver opposite the bolt catch button 20. Actual dimensions will vary for this platform and for others and still be within the purview of this specification and the appended claims. In this preferred exemplary embodiment, the head 12 and plate 14 are secured together with one bolt 16, though any number of bolts or other securing strategies and structure may be used, depending on final shape and size of the head 12 and plate 14 structures. It should be noted that the angle θ and lengths of legs 18*a* and 18*b* are variable for operable co-operation. Appropriate materials for manufacturing the BAD include metal, durable polymers and composite materials.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. In combination with a firearm, a battery assist device for a firearm, the battery assist device comprising:

a. a hooked lever, said lever having an attachment end and a projection end opposite;

b. an attachment head situated at the attachment end of the lever; and c. an attachment plate securable to a rear side of the attachment head, between a bolt catch button and a receiver of the firearm;

wherein the attachment head and attachment plate secure the bolt catch button of the firearm between them when mutually attached such that the device depends from the bolt catch button and the projection end protrudes across the firearm to an opposite side, in a vicinity of a trigger guard of the firearm.

2. The battery assist device of claim 1, the hooked lever having two legs at approximately a 90° angle to each other.

3. The battery assist device of claim 1, the hooked lever protruding underneath the firearm in a region about a trigger of the firearm.

4. The battery assist device of claim 1, the attachment plate and attachment head being mutually secured by at least one bolt.

5. The battery assist device of claim 1, said device being manufactured from a material selected from the group of materials consisting of metals, polymers and composites.

* * * * *

UNITED STATES PATENT AND TRADEMARK OFFICE

CERTIFICATE OF CORRECTION

PATENT NO. : 8,161,861 B2
APPLICATION NO. : 12/540345
DATED : April 24, 2012
INVENTOR(S) : Travis D. Haley et al.

It is certified that error appears in the above-identified patent and that said Letters Patent is hereby corrected as shown below:

On the cover page, Item (75) Inventors: after Eric C. Burt, Broomfield, CO (US) insert -- Michael Matthew Curry, Palm Jumeriah, Dubai, UAE. --

Signed and Sealed this
First Day of January, 2013

David J. Kappos

David J. Kappos
*Director of the United States Patent and Trademark Office*